US012584372B2

(12) United States Patent
Schultz et al.

(10) Patent No.: US 12,584,372 B2
(45) Date of Patent: Mar. 24, 2026

(54) ANCHORING PLUGGING DEVICES TO PERFORATIONS

(71) Applicant: THRU TUBING SOLUTIONS, INC., Newcastle, OK (US)

(72) Inventors: Roger L. Schultz, Ninnekah, OK (US); Gary P. Funkhouser, Moore, OK (US)

(73) Assignee: THRU TUBING SOLUTIONS, INC., Newcastle, OK (US)

( * ) Notice: Subject to any disclaimer, the term of this patent is extended or adjusted under 35 U.S.C. 154(b) by 0 days.

(21) Appl. No.: 18/805,938

(22) Filed: Aug. 15, 2024

(65) Prior Publication Data

US 2025/0075587 A1 Mar. 6, 2025

Related U.S. Application Data

(60) Provisional application No. 63/579,742, filed on Aug. 30, 2023.

(51) Int. Cl.
*E21B 33/12* (2006.01)
*E21B 23/01* (2006.01)

(52) U.S. Cl.
CPC ..... *E21B 33/1216* (2013.01); *E21B 23/01* (2013.01)

(58) Field of Classification Search
CPC ..... E21B 33/1216; E21B 23/01; E21B 23/06; E21B 33/12
See application file for complete search history.

(56) References Cited

U.S. PATENT DOCUMENTS 2,933,136 A * 4/1960 Ayers ..... E21B 43/25 166/325
3,292,700 A * 12/1966 Berry ..... E21B 43/261 166/100
3,376,934 A * 4/1968 William ..... E21B 43/261 166/284
3,417,821 A * 12/1968 Tinsley ..... E21B 43/267 166/308.1
3,437,147 A * 4/1969 Davies ..... E21B 33/134 166/284
4,924,811 A * 5/1990 Axelrod ..... A61D 5/00 119/710
5,253,709 A * 10/1993 Kendrick ..... E21B 33/138 166/284
5,477,815 A * 12/1995 O'Rourke ..... A01K 15/026 119/710
5,908,073 A * 6/1999 Nguyen ..... E21B 43/267 166/278
8,950,438 B2 * 2/2015 Ryan ..... F16L 55/1645 166/292
9,523,267 B2 * 12/2016 Schultz ..... E21B 43/11
9,551,204 B2 * 1/2017 Schultz ..... E21B 33/13
9,567,824 B2 * 2/2017 Watson ..... E21B 33/13
9,567,825 B2 * 2/2017 Schultz ..... E21B 33/13
(Continued)

*Primary Examiner* — Steven A Macdonald
(74) *Attorney, Agent, or Firm* — Smith IP Services, P.C.

(57) ABSTRACT

A method for use with a subterranean well can include deploying a plugging device and anchor into the well, conveying the anchor into a perforation and blocking fluid flow through the perforation with the plugging device. A system for use with a subterranean well can include a plugging device configured to engage and block fluid flow through a perforation in the well, and an anchor attached to the plugging device, the anchor being configured to grip an interior surface of the perforation.

19 Claims, 4 Drawing Sheets

(56) References Cited

U.S. PATENT DOCUMENTS 9,567,826 B2 * 2/2017 Schultz ..... E21B 43/114
9,708,883 B2 * 7/2017 Schultz ..... E21B 43/263
9,745,820 B2 * 8/2017 Watson ..... E21B 43/11
9,816,341 B2 * 11/2017 Funkhouser ..... E21B 43/114
9,920,589 B2 * 3/2018 Watson ..... E21B 43/11
10,233,719 B2 * 3/2019 Schultz ..... E21B 33/13
10,513,653 B2 * 12/2019 Schultz ..... E21B 33/13
10,513,902 B2 * 12/2019 Funkhouser ..... E21B 17/20
10,641,069 B2 * 5/2020 Schultz ..... E21B 43/12
10,641,070 B2 * 5/2020 Schultz ..... E21B 43/12
10,655,426 B2 * 5/2020 Watson ..... E21B 43/114
10,738,564 B2 * 8/2020 Watson ..... E21B 33/13
10,738,565 B2 * 8/2020 Schultz ..... E21B 43/114
10,738,566 B2 * 8/2020 Schultz ..... E21B 33/13
10,767,442 B2 * 9/2020 Schultz ..... E21B 43/263
10,774,612 B2 * 9/2020 Watson ..... E21B 43/261
10,851,615 B2 * 12/2020 Watson ..... E21B 33/13
10,900,312 B2 * 1/2021 Funkhouser ..... E21B 29/02
10,907,430 B2 * 2/2021 Funkhouser ..... E21B 17/20
11,002,106 B2 * 5/2021 Watson ..... E21B 27/04
11,242,727 B2 * 2/2022 Watson ..... E21B 33/138
11,293,578 B2 * 4/2022 Phillis ..... F16L 55/162
11,427,751 B2 * 8/2022 Schultz ..... E21B 43/261
2003/0160391 A1 * 8/2003 McEwan ..... F16L 55/162
277/650
2007/0169935 A1 * 7/2007 Akbar ..... E21B 33/138
166/284
2007/0187099 A1 * 8/2007 Wang ..... E21B 33/138
166/295
2008/0220991 A1 * 9/2008 Slay ..... E21B 33/134
524/847
2009/0101334 A1 * 4/2009 Baser ..... E21B 33/138
166/284
2010/0122813 A1 * 5/2010 Trummer ..... E21B 33/02
166/255.1
2010/0152070 A1 * 6/2010 Ghassemzadeh ..... C09K 8/035
507/221
2010/0200235 A1 * 8/2010 Luo ..... C09K 8/62
507/265
2011/0198812 A1 * 8/2011 Ryan ..... F16L 55/164
277/314
2011/0221137 A1 * 9/2011 Obi ..... F16L 55/162
277/316
2012/0013893 A1 * 1/2012 Maida ..... E21B 47/135
356/73.1
2012/0285695 A1 * 11/2012 Lafferty ..... C09K 8/03
166/310
2013/0098600 A1 * 4/2013 Roberts ..... B29D 99/0042
156/186
2013/0327528 A1 * 12/2013 Frost ..... E21B 37/06
166/310
2015/0060069 A1 * 3/2015 Potapenko ..... E21B 33/138
166/187
2015/0060072 A1 * 3/2015 Busby ..... C09K 8/92
166/305.1
2015/0083423 A1 * 3/2015 Brannon ..... C09K 8/62
166/292
2015/0191988 A1 * 7/2015 Kiesel ..... E21B 34/14
166/373
2016/0237767 A1 * 8/2016 Snoswell ..... C09K 8/487
2016/0319628 A1 * 11/2016 Schultz ..... E21B 43/12
2016/0319630 A1 * 11/2016 Watson ..... E21B 33/13
2016/0319631 A1 * 11/2016 Schultz ..... E21B 43/114
2016/0319632 A1 * 11/2016 Schultz ..... E21B 43/114
2016/0348465 A1 * 12/2016 Schultz ..... E21B 33/138
2016/0348466 A1 * 12/2016 Schultz ..... E21B 33/138
2016/0348467 A1 * 12/2016 Watson ..... E21B 33/13
2017/0030169 A1 * 2/2017 Funkhouser ..... E21B 33/138
2017/0107784 A1 * 4/2017 Watson ..... E21B 33/13
2017/0107786 A1 * 4/2017 Schultz ..... E21B 33/13
2017/0260828 A1 * 9/2017 Watson ..... E21B 33/138
2017/0275961 A1 * 9/2017 Schultz ..... E21B 33/138
2017/0275965 A1 * 9/2017 Watson ..... E21B 33/138
2017/0335651 A1 * 11/2017 Watson ..... E21B 43/11
2018/0045010 A1 * 2/2018 Funkhouser ..... E21B 29/02
2018/0148994 A1 * 5/2018 Schultz ..... C09K 8/516
2019/0162034 A1 * 5/2019 Funkhouser ..... E21B 29/02
2019/0162035 A1 * 5/2019 Funkhouser ..... E21B 17/20
2020/0124223 A1 * 4/2020 Phillis ..... F16L 55/162
2021/0171817 A1 * 6/2021 Funkhouser ..... E21B 33/1208

* cited by examiner

ANCHORING PLUGGING DEVICES TO PERFORATIONS

CROSS-REFERENCE TO RELATED APPLICATION

This application claims benefit of the filing date of U.S. provisional application No. 63/579,742 filed on 30 Aug. 2023. The entire disclosure of the prior application is incorporated herein for all purposes by this reference.

BACKGROUND

This disclosure relates generally to equipment utilized and operations performed in conjunction with subterranean well and, in an example described below, more particularly provides for anchoring plugging devices to perforations in a well.

Wells are typically fractured or otherwise treated in stages. While treatment fluid is being injected into one zone, fluid flow into any other perforated zone should generally be prevented. Preventing fluid flow into a previously treated zone is merely one example of a need for techniques to control fluid flow in a well.

It will, therefore, be readily appreciated that improvements are continually needed in the art of controlling fluid flow in a well. The present disclosure provides such improvements to the art, which improvements may be used with a wide variety of different well operations.

DETAILED DESCRIPTION

Figure 1:
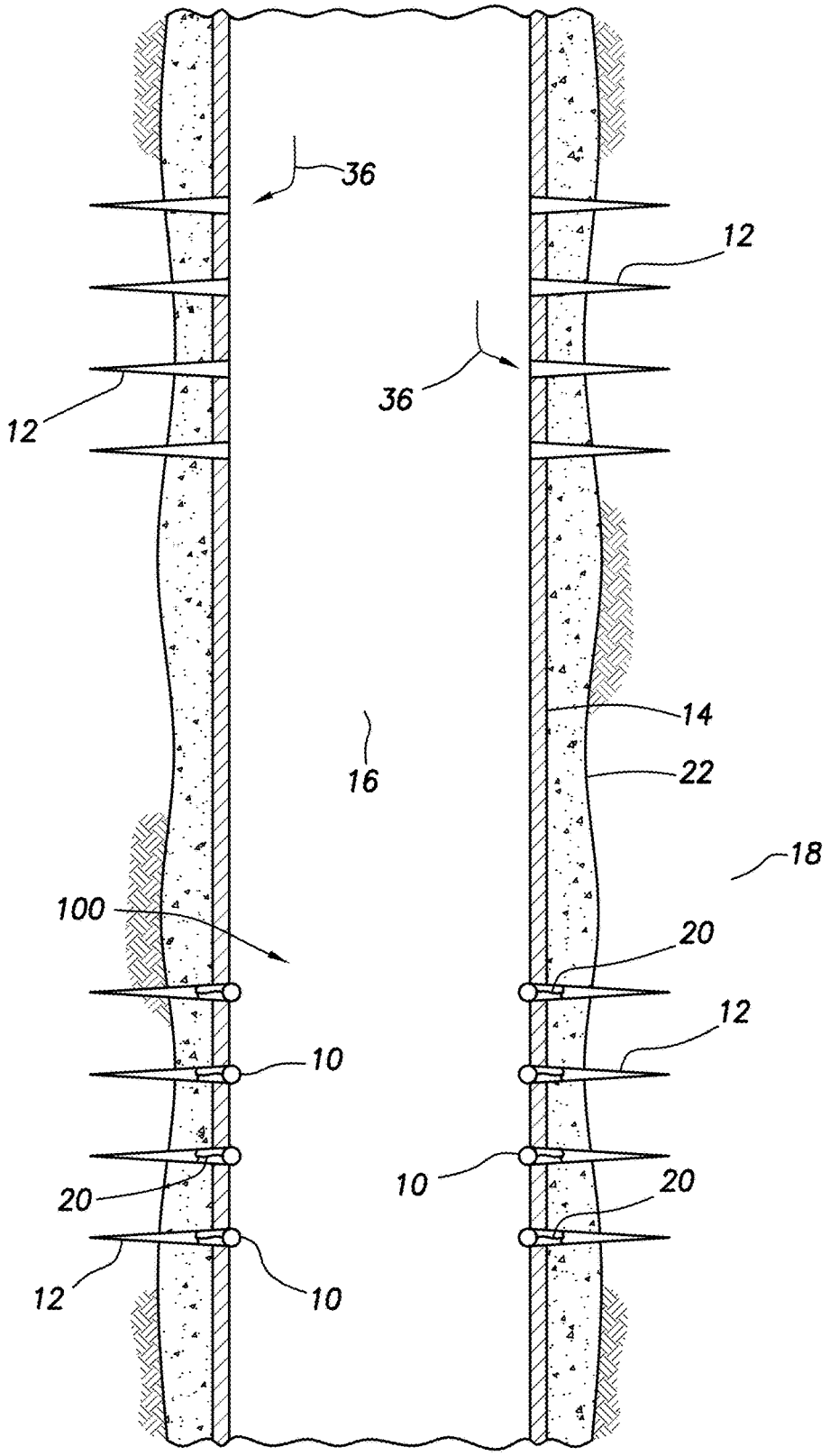
FIG. 1 is a representative partially cross-sectional view of an example of a well system and associated method which can embody principles of this disclosure.

Representatively illustrated in FIG. 1 is a system 100 for use with a subterranean well, and an associated method, which can embody principles of this disclosure. However, it should be clearly understood that the system 100 and method are merely one example of an application of the principles of this disclosure in practice, and a wide variety of other examples are possible. Therefore, the scope of this disclosure is not limited at all to the details of the system 100 and method described herein and/or depicted in the drawings.

As depicted in FIG. 1, plugging devices 10 are used to block flow into perforations 12 for applications such as frac plug replacement in hydraulic fracturing completions. In order to effectively replace frac plugs, the plugging devices 10 must stay on the perforations 12 until they are no longer needed. This could require the plugging devices 10 to stay in place for several frac stages.

Well operations during the completion may sometimes result in a situation where pressure outside of liner or casing 14 is greater than pressure in a wellbore 16 (reverse differential pressure). A reverse differential pressure can cause plugging devices 10 to come off of perforations 12 (no longer blocking flow between the wellbore 16 and an earth formation 18, resulting in loss of isolation of previously treated stages.

The wellbore 16 is lined with the liner or casing 14, and cement 22 as depicted in FIG. 1. In other examples, the perforations 12 may not extend through casing or cement. The casing 14 may be another type of tubular or pipe. Thus, the scope of this disclosure is not limited to any particular structures or configurations of the system 100 as depicted in FIG. 1 or described herein.

In the FIG. 1 example, a first stage has been pumped and plugging devices 10 have been deployed into the wellbore 16 to block further flow into the first stage perforations 12. A second stage can now be pumped through unplugged perforations 12 in the second stage (e.g., with fracturing fluid 36, or another stimulation or conformance fluid, etc.).

The plugging devices 10 have anchors 20 attached to them. The anchors 20 pass into the first stage perforations 12 and grip or become wedged into the perforations. Main bodies of the plugging devices 10 engage and seal against the perforations 12, but do not pass through the perforations. Bodies of the plugging devices 10 may be too large to pass through the perforations 12, but the bodies may partially enter into the perforations.

Thus, to prevent a plugging device 10 from coming off of a perforation 12, for whatever reason, an anchor 20 can be attached to the plugging device (for example, at or near outer ends of lines extending outwardly from a body of the plugging device). The anchor 20 can flow into the perforation 12 before the main body of the plugging device 10. The main body of the plugging device 10 may be too large to pass through the perforation 12.

The anchor 20 does not impede the normal function of the plugging device 10, but prevents the plugging device from coming off of the perforation 12 if a reverse differential pressure event occurs. Even if the plugging device 10 is unseated, it will be in close proximity to the perforation 12 and can reseat on the perforation once a normal differential pressure (from the wellbore 16 to the formation 18) is restored. The anchor 20 may be made of degradable material to prevent permanent blockage of the perforation 12 during subsequent hydrocarbon production.

Representatively illustrated in FIGS. 2-6 are examples of a plugging device 10 and associated method which can embody principles of this disclosure. However, it should be clearly understood that the plugging device 10 and method are merely one example of an application of the principles of this disclosure in practice, and a wide variety of other examples are possible. Therefore, the scope of this disclosure is not limited at all to the details of the plugging device 10 and method described herein and/or depicted in the drawings.

Figure 2:
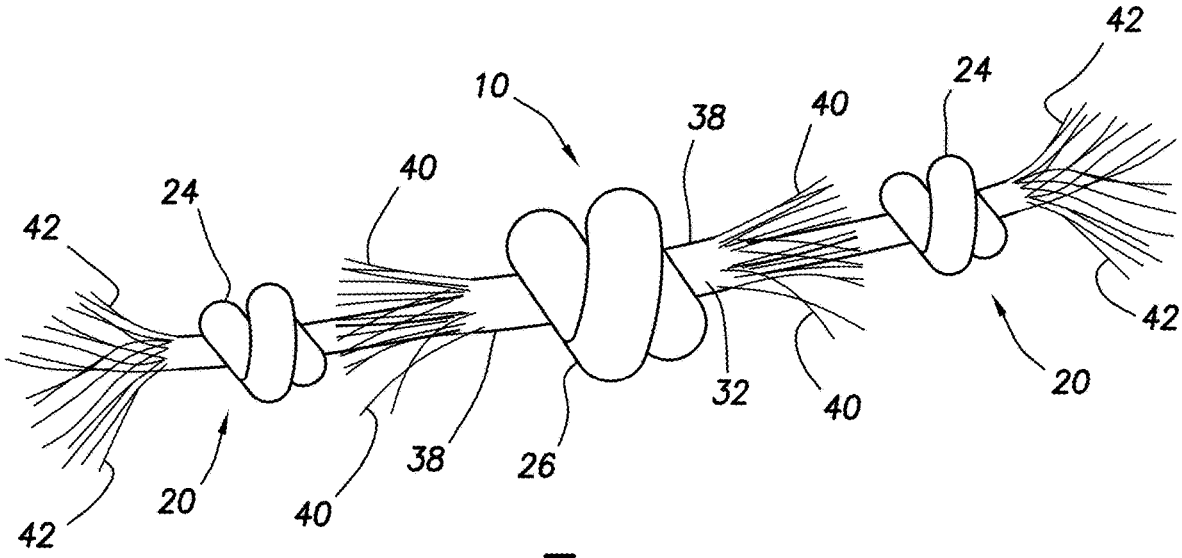
FIG. 2 is a side view of a first example of a plugging device and anchor that may be used with the FIG. 1 system and method.

In the FIG. 2 example, the anchor 20 comprises a knot 24 with dimensions such that it will flow through a perforation 12 under the normal differential pressure during completion, but not flow back through the perforation under typical reverse differential pressure occurrences. The knot 24 could be made from the same material as the main plugging device body 26 to allow degradation of the anchor 20 after the well is completed.

Figure 3:
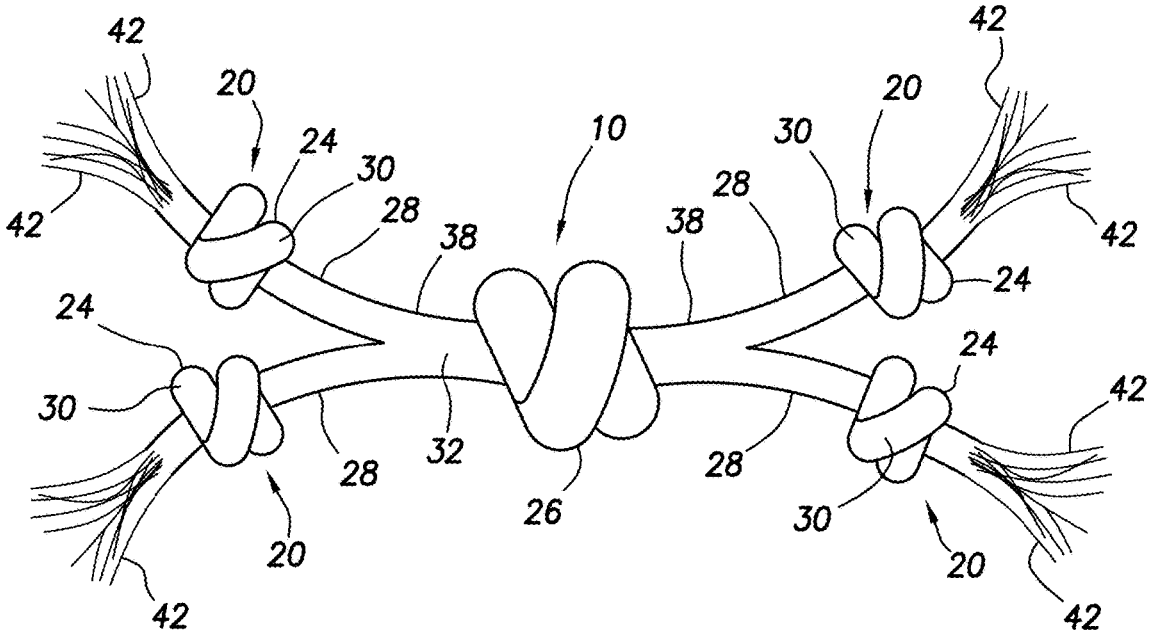
FIG. 3 is a side view of a second example of the plugging device and anchor.

In the FIG. 3 example, the anchor 20 comprises an appendage 28 made of a delayed swelling material with initial dimensions that allow it to flow through the perforation 12. One embodiment comprises a small core made of water-degradable material (e.g., a knot 24 made of the same material as the main plugging device 10) that is coated with a slurry of super-absorbent polymer (e.g., sodium poly-acrylate) in a poly-vinyl chloride (PVC) plastisol that was heated to set the plastisol. Although the PVC and super-absorbent polymer coating 30 are not degradable, degradation of the core of the anchor 20 would allow the remaining portion of the anchor to flow out of the perforation 12.

Figure 4:
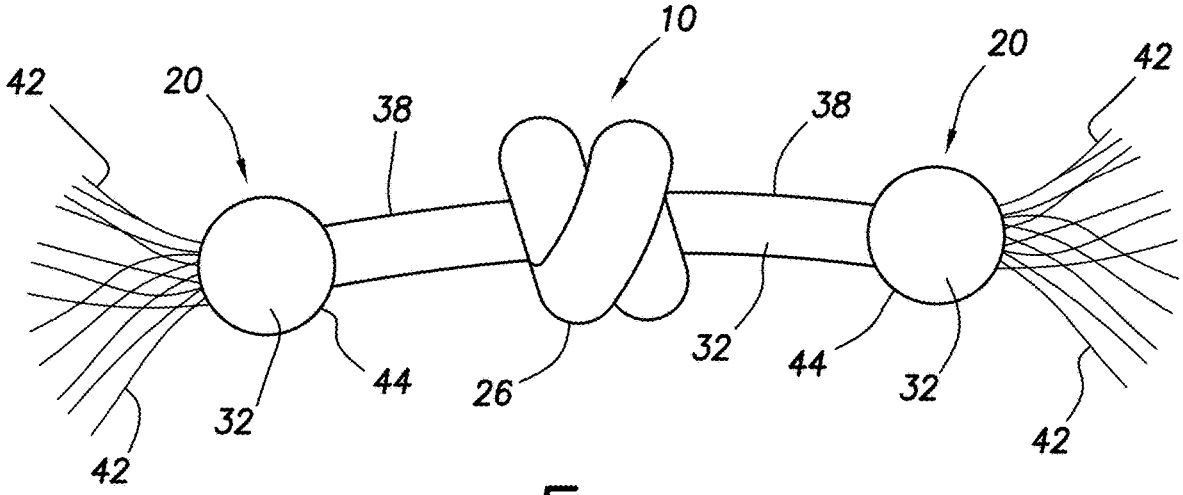
FIG. 4 is a side view of a third example of the plugging device and anchor.

In the FIG. 4 example, the anchor comprises a degradable material 32 (such as, a rubber material) of a size and hardness that allow it to flow through the perforation 12 under the normal differential pressure during completion, but not flow back through the perforation under typical reverse differential pressure occurrences. After the well is completed, the material 32 will degrade and allow flow of hydrocarbons or other fluids through the perforation 12.

Figure 5:
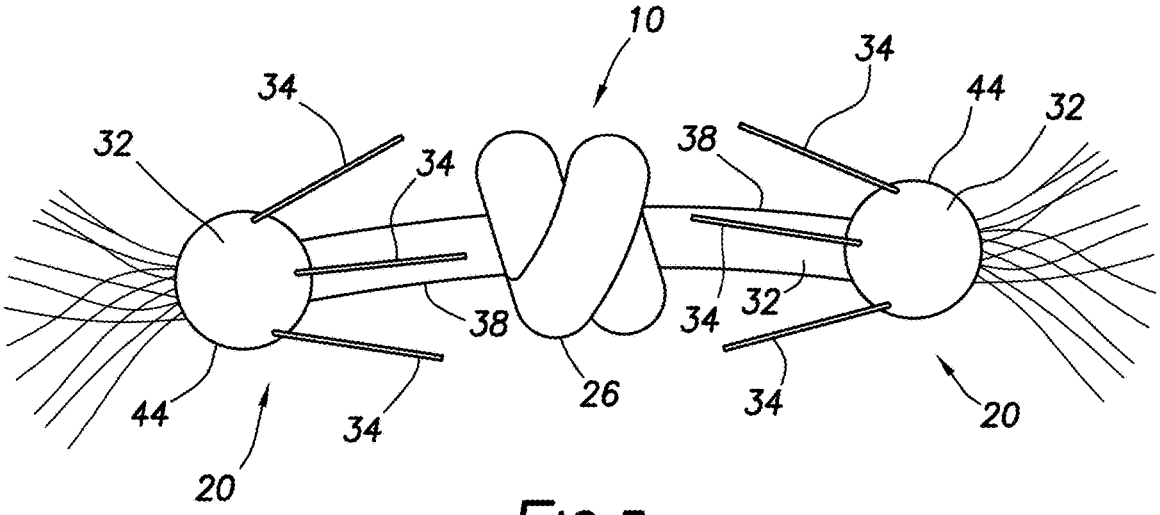
FIG. 5 is a side view of a fourth example of the plugging device and anchor.

In the FIG. 5 example, the plugging device 10 comprises a foldable wire anchor 20. Wires 34 (or other relatively stiff but resilient elongated members) are inserted in a degradable material 32 of a size that can easily pass through the perforation 12. The wires 34 projecting out from the anchor 20 can be angled back toward the main body 26 of the plugging device 10 to facilitate passage through the perforation 12. Once through the perforation 12, the wires 34 spring back to a shape that prevents passage of the anchor 20 back through the perforation 12 during reverse differential pressure events. After the well is completed, degradation of the anchor 20 material 32 leaves only wires 34 that will not impede flow.

Figure 6:
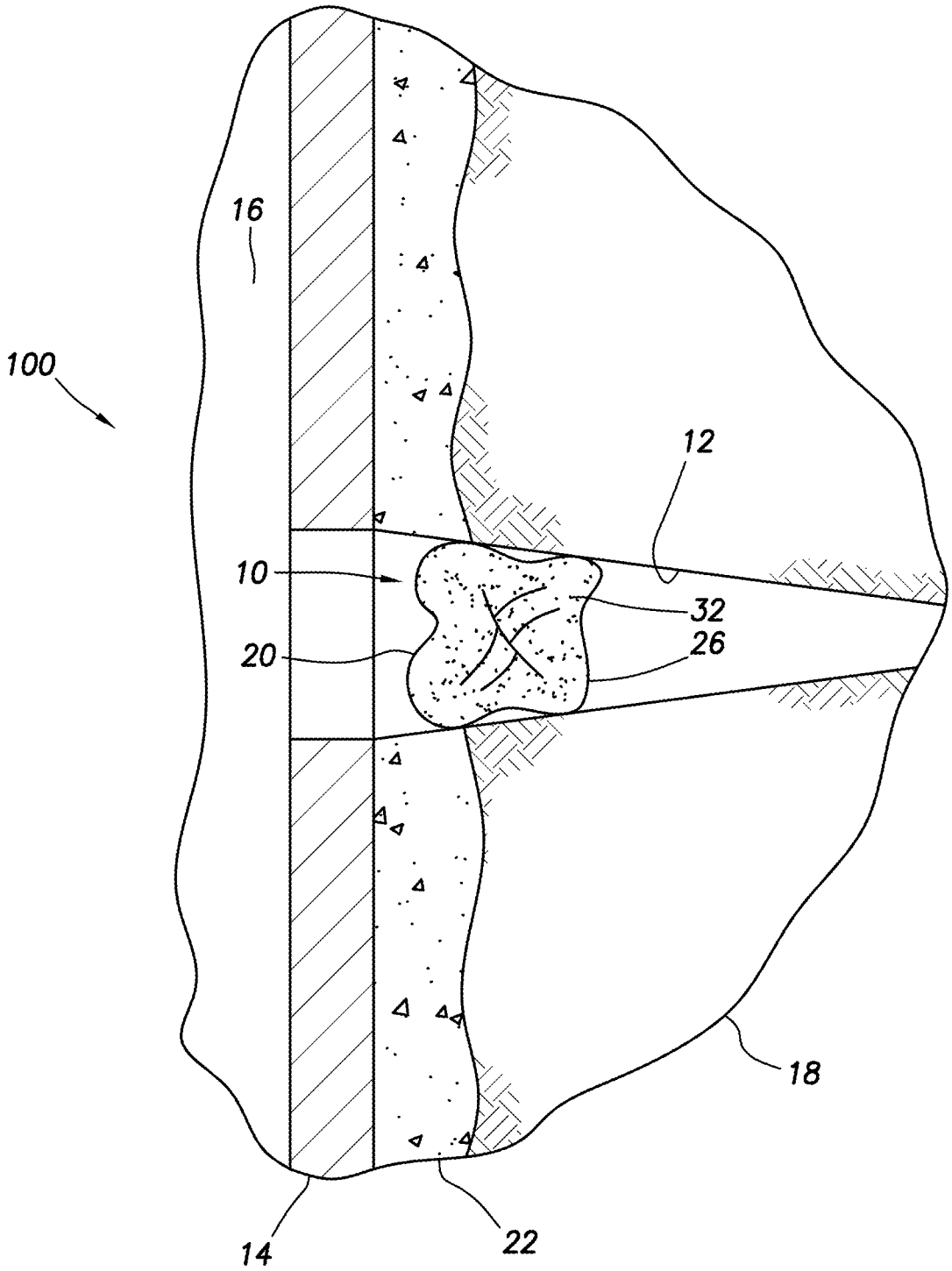
FIG. 6 is a side view of a fifth example of the plugging device and anchor as used in the FIG. 1 system and method.

In the FIG. 6 example, the anchor 20 comprises a mass (e.g., moulded shape, tied knot) of degradable material 32 (such as, polyvinyl alcohol (PVA)) with dimensions such that it will flow through the perforation 12 under the normal differential pressure during completion, but not flow back through under typical reverse differential pressure occurrences. A dissolution temperature of the PVA can be selected to be above the temperature of the fracturing fluid 36 (see FIG. 1), but below the static temperature of the formation 18. After the well is completed, the PVA anchor 20 will dissolve as the wellbore 16 heats up.

In some examples of a plugging device 10 and associated method described herein, the plugging device has an anchor 20 attached to a body 26 of the plugging device. The anchor 20 may pass into a first stage perforation 12 and grip or become wedged into the perforation. The body 26 of the plugging device 10 engages and seals against the perforation 12, but does not pass through the perforation. The body 26 may be too large to pass through the perforation 12, but the body may partially enter into the perforation.

In some examples, the anchor 20 may comprise a knot 24 or other structure with dimensions such that it will flow through the perforation 12 under normal differential pressure during a completion operation, but not flow back through or out of the perforation under typical reverse differential pressure occurrences. The knot 24 could be made from the same material 32 as the plugging device body 26 to allow degradation of the anchor 20 after the well is completed.

In some examples, the anchor 20 may comprise an appendage 28 made of a delayed swelling material with initial dimensions that allow it to flow into the perforation 12. One embodiment is a small core made of water-degradable material (e.g., knot 24 made of the same material 32 as the plugging device body 26) that is coated with a slurry of super-absorbent polymer (e.g., sodium poly-acrylate) in a PVC plastisol that was heated to set the plastisol (e.g., the coating 30 depicted in FIG. 3). Although the PVC coating and superabsorbent polymer are not degradable, degradation of the core of the anchor 20 would allow the remaining portion of the anchor to flow out of the perforation 12.

In some examples, the anchor 20 comprises a degradable material 32 (such as, rubber) of a size and hardness that allow it to flow into the perforation 12 under normal differential pressure during completion, but not flow back out of the perforation under typical reverse differential pressure occurrences. After the well is completed, the material 32 will degrade and allow flow of hydrocarbons or other fluids through the perforation 12.

In some examples, the anchor 20 comprises a foldable wire anchor 20. Wires 34 are inserted in a degradable anchor material 32 of a size that can easily pass into the perforation 12. The wires 34 projecting out from the anchor 20 can be angled back toward the body 26 of the plugging device 10 to facilitate passage through the perforation 12. Once into the perforation 12, the wires 34 spring back to a shape that prevents passage of the anchor 20 back through the perforation 12 during reverse differential pressure events. After the well is completed, degradation of the anchor 20 leaves only wires 34 that will not impede flow.

In some examples, the anchor 20 comprises a mass (e.g., moulded shape, tied knot 24) of polyvinyl alcohol (PVA) or other degradable material 32 with dimensions such that it will flow into the perforation 12 under the normal differential pressure during completion, but not flow back through under typical reverse differential pressure occurrences. The dissolution temperature of the PVA can be selected to be above the temperature of the fracturing/treatment fluid 36, but below the static temperature of the formation 18. After the well is completed, the PVA anchor 20 will dissolve as the wellbore 16 heats up.

Referring specifically now to FIG. 1, the system 100 and method are depicted after a first stage has been treated (e.g., stimulated, fractured, acidized, etc.) by injecting treatment fluid 36 through perforations 12 and into the formation 18. The first stage perforations 12 are then plugged with the plugging devices 10, so that the treatment fluid 36 will subsequently be injected through perforations 12 of a second stage (uphole of the first stage in the FIG. 1 example).

When the plugging devices 10 are deployed into the wellbore 16 to plug the perforations 12 of the first stage, fluid flow will carry the anchors 20 into the perforations, and will carry the plugging devices into sealing engagement with the casing 14 surrounding the perforations. The plugging devices 10 thereby block flow through the perforations 12 (e.g., between the wellbore 16 and the formation 18), and the anchors 20 retain the plugging devices proximate the perforations.

It will be appreciated that the plugging devices 10 will be retained against the perforations 12 when a positive pressure differential exists from the wellbore 16 to the formation 18. However, a pressure differential from the formation 18 to the wellbore 16 will tend to bias the plugging devices away from the perforations and into the wellbore. The anchors 20 prevent the plugging devices 10 from falling away from the perforations 12 (although the anchors do not necessarily maintain the plugging devices in sealing engagement with the casing 14 surrounding the perforations).

The anchors 20 in the FIG. 1 example grip interior surfaces of the perforations 12. The interior surfaces gripped by the anchors 20 could be formed in the casing 14, the cement 22 or the formation 18, depending on how far the anchors extend into or through the perforations 12.

The anchors 20 may include gripping surfaces or members to grip the interior surfaces of the perforations 12, or the anchors may become wedged into the perforations due to the fluid flow from the wellbore 16 to the formation 18 that carries the anchors into the perforations. In this example, the anchors 20 do not block or prevent fluid flow in either direction through the perforations 12. In other examples, the anchors 20 may partially or completely block or prevent fluid flow through the perforations 12.

The plugging devices 10 may have any suitable structure or form. In the FIG. 1 example, each plugging device 10 is shaped, dimensioned and configured to prevent or block fluid flow from the wellbore 16 to the formation 18 through a perforation 12. The plugging device 10 may sealingly engage the casing 14 about a perimeter of the perforation 12. The plugging device 10 may extend partially or fully into the perforation 12.

In other examples, the perforation 12 may not extend through casing 14, and the plugging device 10 may not sealingly engage casing. In such examples, the plugging device 10 may still seal about a periphery of the perforation 12 or otherwise block fluid flow through the perforation.

The plugging device 10 may be the same as, or similar to, any of the plugging devices described in U.S. Pat. Nos. 9,816,341, 10,233,719 and 10,851,615, the entire disclosures of which are incorporated herein by this reference for all purposes. However, the scope of this disclosure is not limited to use of any particular type of plugging device.

Referring additionally now to FIG. 2, an example of the plugging device 10 and the anchor 20 is representatively illustrated. In this example, two of the anchors 20 are attached to, and extend in opposite directions from, the plugging device 10.

The plugging device 10 includes the body 26, which is too large to pass through the perforation 12 (although the body could extend partially into the perforation). The body 26 is in the form of a knot as depicted in FIG. 2, but in other examples the body 26 could be spherical or another shape suitable for blocking fluid flow through the perforation 12.

In the FIG. 2 example, the body 26 is formed by tying a knot in a line 38 (such as, a rope, twine, yarn, an elongated tube or strip, etc.). The line 38 (and any other component of the plugging device 10) may comprise a material 32 selected to be degraded in a well. For example, the material 32 could dissolve in fluid in the well, the material could melt at downhole temperatures, the material could degrade in response to a stimulus introduced into the well at a selected time, etc. The scope of this disclosure is not limited to use of any particular type of degradable material.

Strands, filaments or fibers 40 extend outward on the plugging device 10. The fibers 40 increase fluid drag on the plugging device 10, to aid in conveying the plugging device to an open perforation 12. In some examples, the fibers 40 may assist in sealing between the body 26 and the perforation 12 (such as, by filling any gaps between the body and the casing 14 or the periphery of the perforation 12).

The fibers 40 may be splayed apart ends of the line 38 in some examples. In other examples, the fibers 40 could extend outward from the body 26.

As depicted in FIG. 2, each of the anchors 20 includes a knot 24. The knot 24 is dimensioned and shaped, so that it can pass into the perforation 12. Thus, an outer dimension of the knot 24 is less than an outer dimension of the body 26 in this example.

The knot 24 is tied at an outer end of the line 38. Strands, filaments or fibers 42 extend outwardly from the knot 24 to increase fluid drag on the anchor 20, to aid in conveying the anchor to an open perforation 12.

The knot 24 is configured so that, after the anchor 20 has passed into the perforation 12, the knot will become wedged into the perforation. The plugging device body 26 will then sealingly engage the casing 14 about a periphery of the perforation 12, thereby blocking fluid flow through the perforation (e.g., from the wellbore 16 to the formation 18).

With the anchor 20 wedged into the perforation 12, the plugging device 10 is retained in close proximity to the perforation, even in the event that a pressure differential is created from the formation 18 to the wellbore 16. Thus, the plugging device 10 can be re-seated against the perforation 12, if it should become disengaged from the perforation due to the pressure differential from the formation 18 to the wellbore 16.

The anchor 20 can include a body in a shape other than the knot 24 in other examples. For example the anchor body could be spherical or another shape with an appropriate outer surface or structure to grip the interior surface of the perforation 12. Multiple anchors 20 increase the likelihood that an anchor will enter the perforation 12 prior to the plugging device 10 engaging the perforation, although a single anchor may be used in some examples.

Any or all components of the anchor 20 may be made of the degradable material 32, including any of the degradable materials described herein or in the patents incorporated herein.

Referring additionally now to FIG. 3, another example of the plugging device 10 and anchor 20 is representatively illustrated. The FIG. 3 example is similar to the FIG. 2 example, with one difference being that the FIG. 3 example includes four of the anchors 20. The lines 38 on either side of the body 26 are divided to form the appendages 28 that attach the anchor knots 24 to the plugging device 10 in the FIG. 3 example.

In one embodiment, the anchor 20 body comprises a small core made of degradable material with an outer coating 30. For example, the coating 30 could be formed by a slurry of super-absorbent polymer (e.g., sodium poly-acrylate) in a PVC plastisol that was heated to set the plastisol. Although the PVC coating and super-absorbent polymer are not degradable, degradation of the core of the anchor 20 would allow the remaining portion of the anchor to flow out of the perforation 12 when desired.

Referring additionally now to FIG. 4, another example of the plugging device 10 and anchor 20 is representatively illustrated. The FIG. 4 example is similar to the FIG. 2 example, with one difference being that a body 44 of each anchor 20 is in the form of a sphere, instead of a knot. The line 38 extends through each of the anchor bodies 44, so that strands, filaments or fibers 42 at ends of the line are splayed outward on an outer side of the each of the bodies.

The anchor body 44 in this example comprises a degradable material 32 (such as, rubber or any of the other degradable materials referred to herein) of a size and hardness that allow it to flow into the perforation 12 under differential pressure from the wellbore 16 to the formation 18, but not flow back out of the perforation when the differential pressure is from the formation 18 to the wellbore 16. After the well is completed (or at least after treatment of the formation 18), the material 32 will degrade and allow flow of hydrocarbons or other fluids through the perforation 12.

Referring additionally now to FIG. 5, another example of the plugging device 10 and anchor 20 is representatively illustrated. In this example, wires or other elongated, relatively stiff but resilient members 34 extend outward from each of the anchor bodies 44. The members 34 are preferably sufficiently resilient to allow them to deflect inward when the anchor 20 enters a perforation 12, but preferably are sufficiently stiff to bear against the interior surface of the perforation, so that the engagement of the members with the perforation resists removal of the plugging device 10 from the perforation.

The members 34 projecting outward from the anchor body 44 can be inclined toward the body 26 of the plugging device 10 to facilitate passage through the perforation 12. Once into the perforation 12, the members 34 spring back to a shape that prevents passage of the anchor 20 back through the perforation 12, for example, when a differential pressure exists from the formation 18 to the wellbore 16. After the well is completed, degradation of the anchor 20 leaves only the members 34 that do not impede flow (or the members 34 may also be made of a degradable material).

Referring additionally now to FIG. 6, another example of the plugging device 10 and anchor 20 as used in the system 100 is representatively illustrated. In this example, the plugging device 10 and anchor 20 are combined in a single structure, which is capable of blocking fluid flow through the perforation 12, and is also configured to grip an interior surface of the perforation (such as, an interior surface of the casing 14, cement 22 or formation 18) to prevent dislodgment of the plugging device 10 from the perforation.

In the FIG. 6 example, the plugging device 10 and anchor 20 are in the form of a mass (e.g., moulded shape, tied knot 24) of polyvinyl alcohol (PVA) or other degradable material 32 with dimensions such that it will pass with fluid flow into the perforation 12 when the differential pressure is from the wellbore 16 to the formation 18, but not be dislodged from the perforation when the differential pressure is from the formation to the wellbore.

The dissolution temperature of the PVA can be selected to be above the temperature of the fracturing/treatment fluid 36, but below the static temperature of the formation 18. After the well is completed, the PVA anchor 20 will dissolve as the wellbore 16 heats up.

It may now be fully appreciated that the above disclosure provides significant advancements to the art of controlling fluid flow in a well. In examples described herein, one or more actors 20 can be attached to a plugging device 10. The plugging device 10 is configured to block fluid flow through a perforation 12, and the anchor 20 is configured to enter the perforation and grip an interior surface of the perforation to thereby prevent dislodgment of the plugging device from the perforation.

The above disclosure provides to the art a method for use with a subterranean well. In one example, the method can comprise: deploying a plugging device 10 and anchor 20 into the well; conveying the anchor 20 into a perforation 12; and blocking fluid flow through the perforation 12 with the plugging device 10.

The conveying step may comprise the anchor 20 grippingly engaging an interior surface of the perforation 12. Engagement of the anchor 20 with the perforation 12 may maintain the plugging device 10 proximate the perforation 12.

The method may include attaching the anchor 20 to the plugging device 10.

After the blocking step, a material 32 of the anchor 20 may degrade in the well.

The blocking step may include the plugging device 10 sealing about a periphery of the perforation 12.

The blocking step may include the plugging device 10 at least partially passing into the perforation 12.

The anchor 20 may comprise a body 44 positioned at an end of a line 38 extending outward from a body 26 of the plugging device 10.

The plugging device body 26 may have an outer dimension that is greater than an outer dimension of the anchor body 44.

The method may include forming at least one of the anchor body 44 and the plugging device 10 of a degradable material 32.

A system 100 for use with a subterranean well is also provided by the art by the above disclosure. In one example, the system 100 can comprise a plugging device 10 configured to engage and block fluid flow through a perforation 12 in the well, and an anchor 20 attached to the plugging device 10. The anchor 20 is configured to grip an interior surface of the perforation 12.

The anchor 20 may comprise a degradable material 32. The anchor 20 may comprise a body 44 attached to the plugging device 10 with a line 38. The anchor body 44 may comprise a knot 24.

At least one elongated resilient member 34 may extend outwardly from the anchor body 44. The member 34 may be inclined toward the plugging device 10.

The plugging device 10 may comprise a body 26 configured to seal about a periphery of the perforation 12. The anchor 20 may comprise a body 44 having an outer dimension that is less than an outer dimension of the plugging device body 26.

The plugging device 10 and the anchor 20 may be integrally formed.

The anchor 20 may comprise a spherical body 44.

The anchor 20 may comprise a body 44 and fibers 42 extending outwardly from the body 44.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," "upward," "downward," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A method for use with a subterranean well, the method comprising:

deploying a plugging device and anchor into the well;

conveying the anchor into a perforation, in which the anchor comprises at least one elongated resilient member which is inclined toward the plugging device, thereby preventing passage of the anchor back through the perforation during reverse differential pressure events; and blocking fluid flow through the perforation with the plugging device.

2. The method of claim 1, in which the conveying comprises the anchor grippingly engaging an interior surface of the perforation.

3. The method of claim 2, in which engagement of the anchor with the perforation maintains the plugging device proximate the perforation.

4. The method of claim 1, further comprising attaching the anchor to the plugging device.

5. The method of claim 1, further comprising, after the blocking, a material of the anchor degrading in the well.

6. The method of claim 1, in which the blocking comprises the plugging device sealing about a periphery of the perforation.

7. The method of claim 1, in which the blocking comprises the plugging device at least partially passing into the perforation.

8. The method of claim 1, in which the anchor comprises a body positioned at an end of a line extending outward from a body of the plugging device.

9. The method of claim 8, in which the plugging device body has an outer dimension that is greater than an outer dimension of the anchor body.

10. The method of claim 8, further comprising forming at least one of the anchor body and the plugging device of a degradable material.

11. A system for use with a subterranean well, the system comprising:

a plugging device configured to engage and block fluid flow through a perforation in the well; and an anchor attached to the plugging device, in which the anchor comprises at least one elongated resilient member which is inclined toward the plugging device, whereby the resilient member is configured to, when engaged in the perforation, prevent passage of the anchor back through the perforation during reverse differential pressure events.

12. The system of claim 11, in which the anchor comprises a degradable material.

13. The system of claim 11, in which the anchor comprises a body attached to the plugging device with a line.

14. The system of claim 13, in which the anchor body comprises a knot.

15. The system of claim 13, in which the at least one elongated resilient member extends outwardly from the anchor body.

16. The system of claim 11, in which the plugging device comprises a body configured to seal about a periphery of the perforation, the anchor comprises a body, and the plugging device body has an outer dimension that is greater than an outer dimension of the anchor body.

17. The system of claim 11, in which the plugging device and the anchor are integrally formed.

18. The system of claim 11, in which the anchor comprises a spherical body.

19. The system of claim 11, in which the anchor comprises a body and fibers extending outwardly from the body.

* * * * *